US010662039B2

(12) United States Patent
Cui

(10) Patent No.: US 10,662,039 B2
(45) Date of Patent: May 26, 2020

(54) WINCH FOR VEHICLE

(71) Applicant: Ningbo Lianda Winch Co., Ltd., Ningbo (CN)

(72) Inventor: Xiaojun Cui, Ningbo (CN)

( * ) Notice: Subject to any disclaimer, the term of this patent is extended or adjusted under 35 U.S.C. 154(b) by 44 days.

(21) Appl. No.: 16/008,298

(22) Filed: Jun. 14, 2018

(65) Prior Publication Data

US 2019/0300344 A1 Oct. 3, 2019

(30) Foreign Application Priority Data

Mar. 30, 2018 (CN) ..... 2018 1 0294260

(51) Int. Cl.
*B66D 1/38* (2006.01)
*B66D 1/14* (2006.01)

(52) U.S. Cl.
CPC ..... *B66D 1/38* (2013.01); *B66D 1/14* (2013.01); *B66D 2700/0141* (2013.01); *B66D 2700/0191* (2013.01)

(58) Field of Classification Search
CPC ... B66D 1/14; B66D 1/36; B66D 1/38; B66D 2700/0141; B66D 1/0191
See application file for complete search history.

(56) References Cited

U.S. PATENT DOCUMENTS 523,577 A * 7/1894 Ivens ..... B66D 1/36 242/397.3
1,646,804 A * 10/1927 Westwood ..... B66D 1/36 242/397.3
4,123,040 A * 10/1978 Kuzarov ..... B66D 1/28 254/342
4,334,670 A * 6/1982 Kawabe ..... B66D 1/38 242/397.3
2008/0258124 A1* 10/2008 Farmer ..... B66D 1/38 254/323
2018/0229983 A1* 8/2018 Isherwood ..... B66D 1/38

* cited by examiner

*Primary Examiner* — Sang K Kim
*Assistant Examiner* — Nathaniel L Adams
(74) *Attorney, Agent, or Firm* — W&K IP

(57) ABSTRACT

The present disclosure discloses a winch for a vehicle including a base, a winding drum fixed on the base for winding a traction rope, a support fixed on the base, a transmission component, and a reciprocating component for driving the traction rope to reciprocate along an axial direction of the winding drum when the traction rope is wound onto or released from the winding drum. The disclosed winch enables an orderly arrangement of the traction rope when the traction rope is wound on or released from the winding drum.

6 Claims, 5 Drawing Sheets

WINCH FOR VEHICLE

CROSS-REFERENCE TO RELATED APPLICATIONS

This application claims priority to Chinese Patent Application No. 201810294260.2 with a filing date of Mar. 30, 2018. The content of the aforementioned applications, including any intervening amendments thereto, are incorporated herein by reference.

TECHNICAL FIELD

The present disclosure relates to the field of traction devices, and more particularly, to a winch for a vehicle.

BACKGROUND OF THE PRESENT INVENTION

The winch is a traction device that is commonly used to remove obstacles, drag articles, and install facilities. It is widely used in off-road vehicles, agricultural vehicles, yachts, fire rescue vehicles, road wreckers, and other specialized vehicles vehicles.

In the prior arts, the front end of a winch generally comprises a reciprocating component for driving a traction rope to reciprocate in an orderly manner in the direction along the axis of the winch drum when the traction rope is wound. The reciprocating component includes a reciprocating screw. However, the prior reciprocating screw and the winding drum are respectively driven by two separate driving components, which lead to the following disadvantages: it may be difficult to ensure the synchronous operation of the two driving components, resulting in an unordered winding of the traction rope.

In addition, a mudguard has not been provided at the front end of the winding drum of a winch in prior arts. Matter such as sludge may enter the winding drum easily, and cause damage to the winding drum during operation.

SUMMARY OF PRESENT INVENTION

An objective of the present disclosure is to solve some of the problems of prior arts by providing a winch allowing synchronous operation of the reciprocating screw and the winding drum to achieve an orderly winding of the traction rope.

According to an embodiment of the present disclosure, a winch for a vehicle includes a base; a winding drum for winding a traction rope, the winding drum being fixed on the base; a support fixed on the base; a transmission component; and a reciprocating component for driving the traction rope to reciprocate along an axial direction of the winding drum when the traction rope is wound onto or released from the winding drum. The traction rope passes through the reciprocating component. The reciprocating component is mounted on the support. The reciprocating component includes a reciprocating screw rod rotatably connected to the support. One end of the reciprocating screw rod is fixedly connected with a driven wheel. One end of the winding drum is fixed with a main wheel rotating with the winding drum, and the main wheel drives the driven wheel to rotate through the transmission component.

In an embodiment, the reciprocating component further comprises a polished rod fixed on the support, a rope guide block on which the traction rope is threaded, the reciprocating screw rod passing through the rope guide block to drive the rope guide block to move back and forth, a guide sleeve fixed on the rope guide block and in slidable connection with the polished rod, the inner side walls of both ends of the guide sleeve connected with O-rings, each O-ring attached to the outer surface of the polished rod, and teeth fixed on the rope guide block to engage the reciprocating screw rod.

In an embodiment, the transmission component includes a first transmission wheel, a second transmission wheel, a third transmission wheel, a fourth transmission wheel, a first rotating shaft, a second rotating shaft and a mounting housing fixedly connected with the support. The first rotating shaft and the second rotating shaft are rotatably connected to the support and the mounting housing. The axes of the first rotating shaft, the second rotating shaft the reciprocating screw rod and the winding drum are parallel to each other. One end of the first rotating shaft passes through the support. The first transmission wheel is fixed on one end of the first rotating shaft and on a side of the support facing the winding drum. The second transmission wheel is fixed on the other end of the first rotating shaft and on a side of the support facing away from the winding drum. The third transmission wheel and the fourth transmission wheel are both fixed on the second rotating shaft and between the support and the mounting housing. The main wheel drives the first transmission wheel to rotate. The second transmission wheel drives the third transmission wheel to rotate, and the fourth transmission wheel drives the driven wheel to rotate.

In an embodiment, the relationship between the rotation speed n1 of the winding drum, the rotation speed n2 of the reciprocating screw rod, the pitch d of the reciprocating screw rod and the diameter D of the traction rope satisfy the following conditions: $n1\times D\times 95\% \leq n2\times d \leq n1\times D\times 105\%$ or $n2\times d\times 95\% \leq n1\times D \leq n2\times d\times 105\%$.

In an embodiment, the winch further comprises a retractable baffle component fixedly connected to the rope guide block, and the rope guide block reciprocates the baffle component when reciprocating.

In an embodiment, the support includes a first support plate and a second support plate. The first support plate and the second support plate are respectively located at two sides of the winding drum. The baffle component includes a substrate, a first clamping plate and a second clamping plate. The first clamping plate and the second clamping plate are respectively located on two sides of the substrate, and the first clamping plate and the second clamping plate are both slidably connected to the substrate.

In an embodiment, the baffle component further comprises a first transmission plate and a second transmission plate. The first transmission plate is slidably connected to the substrate. The first clamping plate is slidably connected with the first transmission plate. The second transmission plate is slidably connected with the substrate, and the second clamping plate is slidably connected with the second transmission plate.

In an embodiment, the substrate, the first transmission plate and the second transmission plate have a C-shaped cross-section. The first transmission plate and the second transmission plate are both inserted into the substrate. The first clamping plate is inserted in the first transmission plate. The second clamping plate is inserted in the second transmission plate. First limiting bars are arranged at both ends of the substrate. The first transmission plate has first hooks arranged close to the rope guide block and a second limiting bar facing away from the rope guide block. The first clamping plate has second hooks arranged close to the rope guide block and third hooks facing away from the rope guide block. The second transmission plate has fourth hooks arranged close to the rope guide block and a third limiting bar facing away from the rope guide block. The second clamping plate has fifth hooks arranged close to the rope guide block. The first clamping plate has sixth hooks facing away from the rope guide block. When the substrate reciprocates, the first limiting bars are engaged with the first hooks to drive the first transmission plate, the second limiting bar is engaged with the second hooks to drive the first clamping plate, the third hooks and the first support plate are engaged to limit the first clamping plate, the first limiting bars are engaged with the third hooks to drive the second transmission plate, the third limiting bar is engaged with the fourth hooks to drive the second clamping plate, and the sixth hooks are engaged with the second supporting plate to limit the second clamping plate.

In an embodiment, the winch further comprises a casing for covering the winch. The casing is fixedly connected to the base. The casing comprises a let-off port covered by the baffle component for allowing the traction rope to pass through while being wound.

In an embodiment, the casing comprises a primary casing part and a cover plate, the cover plate being hinged to the primary casing part, the primary casing part having a maintenance clearance covered by the cover plate.

Advantages of the disclosed winch include: on the one hand, the synchronization of the movement of the winding drum and the reciprocating component is ensured. The reciprocating component will be driven to move in correspondence with the traction rope wound on the winding drum. The reciprocating component will stop synchronously when the winding drum stops. The reciprocating component effectively serves to enable an orderly arrangement of the traction rope being wound or released. On the other hand, the reciprocating screw rod can be driven by the winding drum to save energy since another driving motor is no longer needed.

DESCRIPTION OF THE DRAWINGS

The present disclosure is illustrated by way of example and not limitation in the figures of the accompanying drawings, in which like references indicate similar elements, and in which.

Reference Numbers

Figure 1:
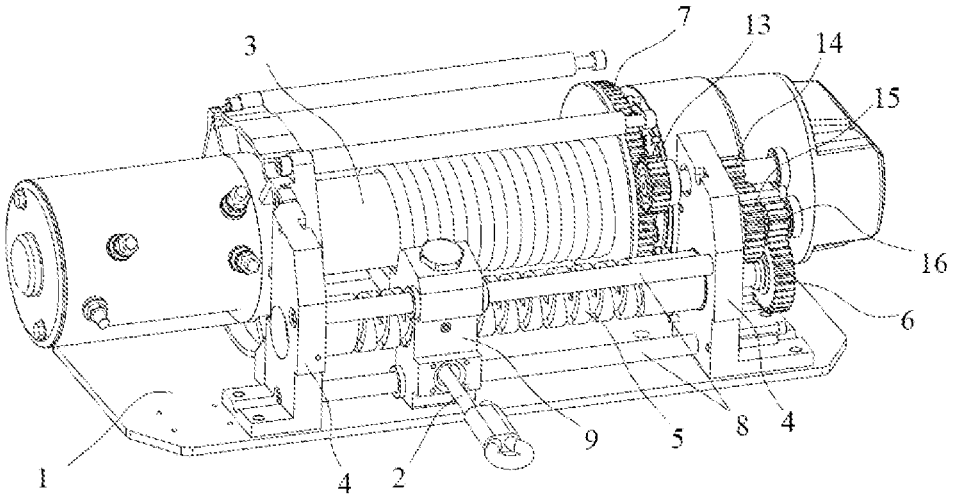
FIG. 1 is a schematic view of a winch of an embodiment.

1 base, 2 traction rope, 3 winding drum, 4 support, 4.1 first support plate, 4.2 second support plate, 5 reciprocating screw rod, 6 driven wheel, 7 main wheel, 8 polished rod, 9 rope guide block, 10 guide sleeve, 11 O-ring, 12 teeth, 13 first transmission wheel, 14 second transmission wheel, 15 third transmission wheel, 16 fourth transmission wheel, 17 first rotating shaft, 18 second rotating shaft, 19 mounting housing, 20 baffle component, 20.1 substrate, 20.2 first clamping plate, 20.3 second clamping plate, 20.4 first transmission plate, 20.5 second transmission plate, 21 first limiting bar, 22 first hook, 23 second limiting bar, 24 second hook, 25 third hook, 26 fourth hook, 27 third limiting bar, 28 fifth hook, 29 casing, 29.1 primary casing part, 29.2 cover plate, 30 let-off port, 31 maintenance clearance, 32 winding drum mounting bracket, 33 gear box cover, 34 mounting seat, 35 ring gear, 36 fixing slot, 37 motor, 38 eccentric wheel, 39 bolt, 40 elastic component, 42 eccentric slot, 43 plug, 44 first limiting block, 45 second limiting block, 46 protrusion block, 47 bolt positioning block, 48 end cap, 49 guide sleeve, 50 sixth hook.

DETAILED DESCRIPTION OF PREFERRED EMBODIMENTS

Various aspects of the illustrative embodiments will be described using terms used by the skilled in the art to convey the substance of their work to other. However, it will be apparent to the skilled in the art that alternate embodiments may be practiced with only some of the described aspects. For purposes of explanation, specific number, materials, and configurations are set forth in order to provide a thorough understanding of the illustrative embodiments. However, it will be apparent to one skilled in the art that alternate embodiments may be practices without the specific details. In other instances, well-known features are omitted or simplified in order not to obscure the illustrative embodiments.

Although the terms first, second, third, left, right, upper, lower, etc. may be used herein to describe various elements, these elements should not be limited by these terms. These terms are only used to distinguish one element from another. Terms such as "first," "second," and other numerical terms when used herein do not imply a sequence or order unless clearly indicated by the context. Thus, a first element could be termed a second element, and a left component could be termed a right component without departing from the teachings of the example embodiments. In addition, the term "and/or" may mean "and", "or", "exclusive-or", "one", "some, but not all", "neither", or "both", although the scope of the claimed subject matter is not limited in this respect. In the following description and/or claims, the terms "comprise" and "include", along with their derivative, may be used and are intended as synonyms for each other.

The terms used herein is for the purpose of describing particular embodiments only and is not intended to be limiting of the invention. As used herein, the singular forms are intended to include the plural forms as well, unless the context clearly indicates otherwise. "Connected" may be used to indicate that two or more elements are in direct physical and/or electrical contact with each other. "Coupled" may mean that two or more elements are in direct or indirect physical and/or electrical contact with each other.

As shown in FIG. 1-11. A winch for a vehicle in an embodiment includes a base 1, a winding drum 3 fixed on the base 1 for winding a traction rope 2, a support 4 fixed on the base 1, a transmission component, and a reciprocating component for driving the traction rope 2 to reciprocate along an axial direction of the winding drum 3 when the traction rope 2 is wound onto or released from the winding drum 3. The traction rope 2 passes through the reciprocating component. The reciprocating component is mounted on the support 4. The reciprocating component includes a reciprocating screw rod 5 rotatably connected to the support 4. One end of the reciprocating screw rod 5 is fixedly connected with a driven wheel 6. One end of the winding drum 3 is fixed with a main wheel 7 rotating with the winding drum 3. The main wheel 7 drives the driven wheel 6 to rotate through the transmission component.

On the one hand, the synchronization of the movement of the winding drum 3 and the reciprocating component is ensured by utilizing the above mentioned winch. The reciprocating component will be driven to move in correspondence with the traction rope 2 wound on the winding drum 3. The reciprocating component will stop synchronously when the winding drum stops 3. The reciprocating component effectively serves to enable an orderly arrangement of the traction rope 2 being wound or released. On the other hand, the reciprocating screw rod 5 can be driven by the winding drum 3 to rotate and save energy since another driving motor is no longer needed.

Figure 3:
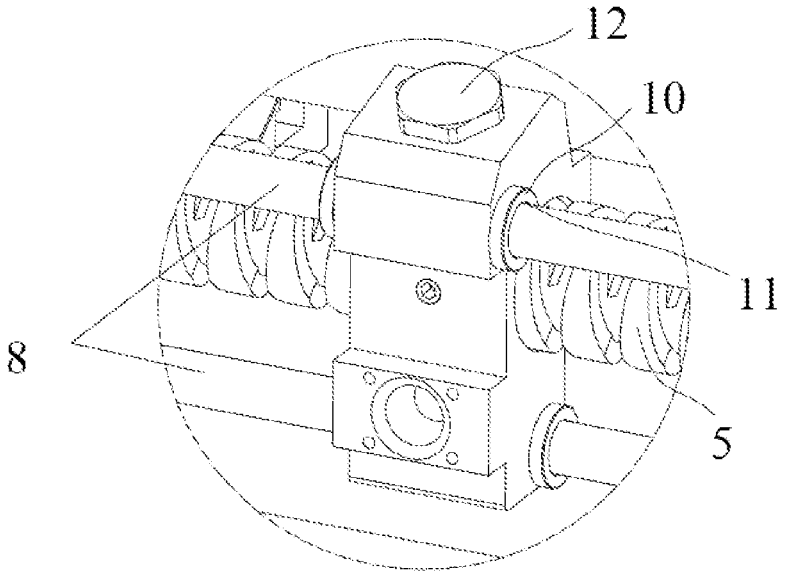
FIG. 3 is an enlarged schematic view of a part A in FIG. 2.

As shown in FIG. 3, the reciprocating component further comprises a polished rod 8 fixed on the support 4, a rope guide block 9 on which the traction rope 2 is threaded, a guide sleeve 10 fixed on the rope guide block 9 and in slidable connection with the polished rod 8, and teeth 12 fixed on the rope guide block 9 to engage the reciprocating screw rod 5. The inner side walls of both ends of the guide sleeve 10 are connected with O-rings 11. Each O-ring 11 is attached to the outer surface of the polished rod 8. The reciprocating screw rod 5 passes through the rope guide block 9 to drive the rope guide block 9 to move back and forth.

In this way, the cooperation of the reciprocating screw 5 and the teeth 12 can enable the reciprocating screw 5 to drive the rope guide block 9 to move back and forth. The traction rope 2 is threaded on the rope guide block 9 so that the traction rope 2 can be released or wound in order when the winding drum 3 is rotated.

The polished rod 8 is slidably connected with the guide sleeve 10 to ensure that the rope guide block 9 follows a consistent track when moving back and forth and that jamming can be avoided. The working stability of the rope guide block 9 can be improved. In addition, the inner sidewalls of both ends of the guide sleeve 10 are snap-fitted with O-rings. The O-rings 11 can be used to prevent dust from entering the guide sleeve 10 and to ensure the interior parts are clean on the one hand. On the other hand, the O-rings 11 are attached to the outer surface of the polished rod 8 to remove dust on the outer surface of the polished rod 8. The working stability of the rope guide block 9 can be improved according to the discussed structures.

In an embodiment, the number of the polished rods 8 is two, and the axes of the two polished rods 8, the reciprocating screw rod 5, and the winding drum 3 are parallel to each other. In this way, the two polished rods 8 can ensure that the rope guide block 9 follows the same predefined track when moving back and forth to avoid jamming.

Figure 2:
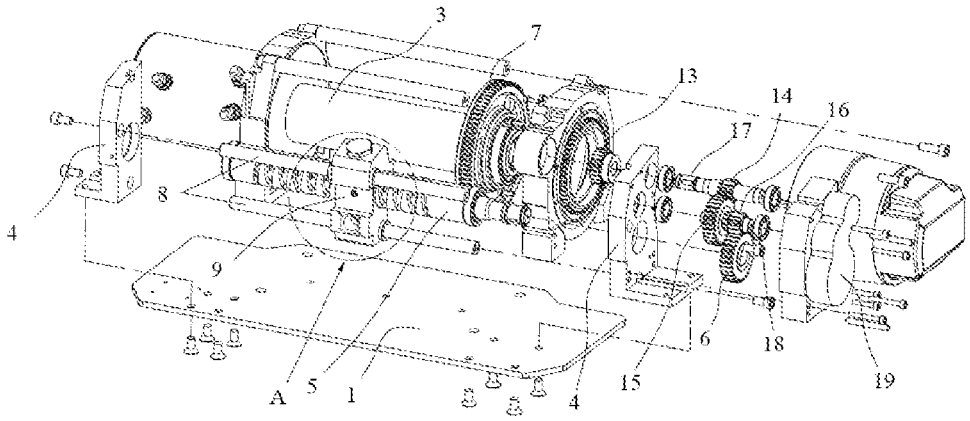
FIG. 2 is an exploded view of a winch of an embodiment.

As shown in FIG. 2, the transmission component includes a first transmission wheel 13, a second transmission wheel 14, a third transmission wheel 15, a fourth transmission wheel 16, a first rotating shaft 17, a second rotating shaft 18 and a mounting housing 19 fixedly connected with the support 4. The first rotating shaft 17 and the second rotating shaft 18 are rotatably connected to the support 4 and the mounting housing 19. The axes of the first rotating shaft 17, the second rotating shaft 18, the reciprocating screw rod 5 and the winding drum 3 are parallel to each other. One end of the first rotating shaft 17 passes through the support 4. The first transmission wheel 13 is fixed on one end of the first rotating shaft 17 and on a side of the support 4 facing the winding drum 3. The second transmission wheel 14 is fixed on the other end of the first rotating shaft 17 and on a side of the support 4 facing away from the winding drum 3. The third transmission wheel 15 and the fourth transmission wheel 16 are both fixed on the second rotating shaft 18 and between the support 4 and the mounting housing 19. The main wheel 7 drives the first transmission wheel 13 to rotate. The second transmission wheel 14 drives the third transmission wheel 15 to rotate, and the fourth transmission wheel 16 drives the driven wheel 6 to rotate.

The arrangement of the above structure can ensure more compact and firm structures, thereby ensuring the stability of the transmission component during transmission. In particular, the driving means may implemented as a belt drive mechanism and/or a tooth drive mechanism. In a belt drive configuration, the main wheel 7, the driven wheel 6, the first transmission wheel 13, the second drive wheel 14, the third transmission wheel 15 and the fourth transmission wheel 16 are pulleys. In a tooth drive configuration, the main wheel 7, the driven wheel 6, the first transmission wheel 13, the second transmission wheel 14, the third transmission wheel 15, and the fourth transmission wheel 16 are gears. Obviously, the belt drive and tooth drive mechanisms can be used interchangeably, although the above-mentioned components are gears in the embodiments of the present disclosure.

In one embodiment, the relationship between the rotation speed n1 of the winding drum 3, the rotation speed n2 of the reciprocating screw rod 5, the pitch d of the reciprocating screw rod and the diameter D of the traction rope 2 satisfy the following conditions: $n1\times D\times 95\% \le n2\times d \le n1\times D\times 105\%$ or $n2\times d\times 95\% \le n1\times D \le n2\times d\times 105\%$. The definition ensures the displacement of the rope guide block 9 per unit time is consistent with the horizontal width the winding drum 3 winds the traction rope 2 per unit time. Therefore, it can prevent inconsistency between the rotation of the winding drum 3 and the displacement of the rope guide block 9 and thereby prevent cross-winding of the traction rope 2 on the winding drum 3. In an embodiment, the definition can be $n1\times D\times 98\% \le n2\times d \le n1\times D\times 102\%$ or $n2\times d\times 98\% \le n1\times D \le n2\times d\times 102\%$. In another embodiment, $n1\times D \le n2\times d$. That is to say, $n2\times d$ can be equal to any of $n1\times D\times 95\%$, $n1\times D\times 98\%$, $n1\times D\times 100\%$, $n1\times D\times 102\%$, and $n1\times D\times 105\%$. Similarly, $n1\times D$ can be equal to any of $n2\times D\times 95\%$, $n2\times D\times 98\%$, $n2\times D\times 100\%$, $n2\times D\times 102\%$, and $n2\times D\times 105\%$.

Figure 4:
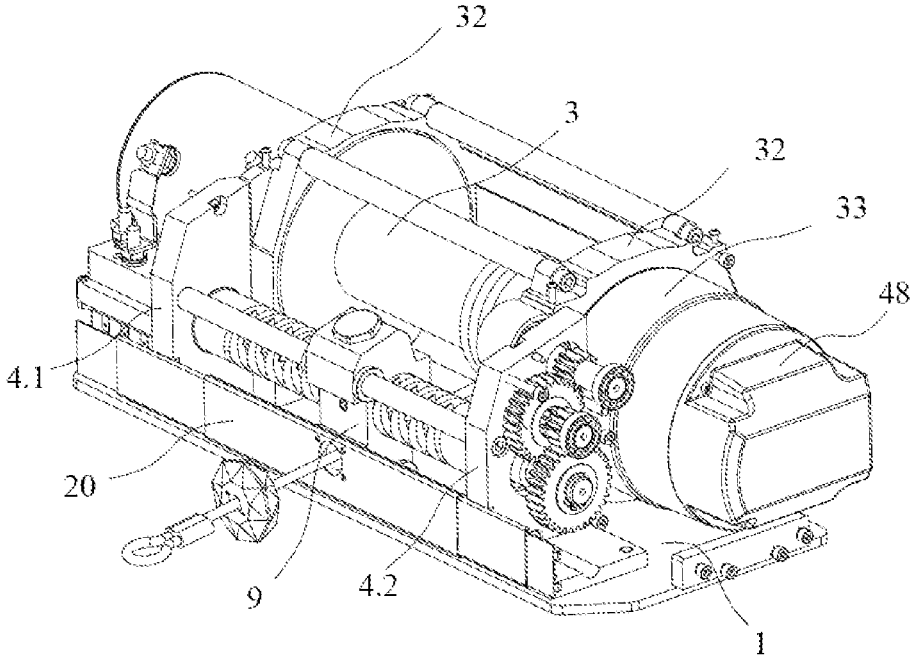
FIG. 4 is a schematic view of the structure of a winch having a baffle component of an embodiment.

In FIG. 4, the winch of an embodiment comprises a retractable baffle component 20 fixedly connected to the rope guide block 9, and the rope guide block 9 reciprocates the baffle component 20 when reciprocating. The baffle component 20 is retractable to ensure the coordination of the movement of the baffle component 20 and the rope guide block 9. The baffle component 20 can block sludge from entering the winding drum 3 and prevents damage to the winding drum 3 during normal operation.

Figure 5:
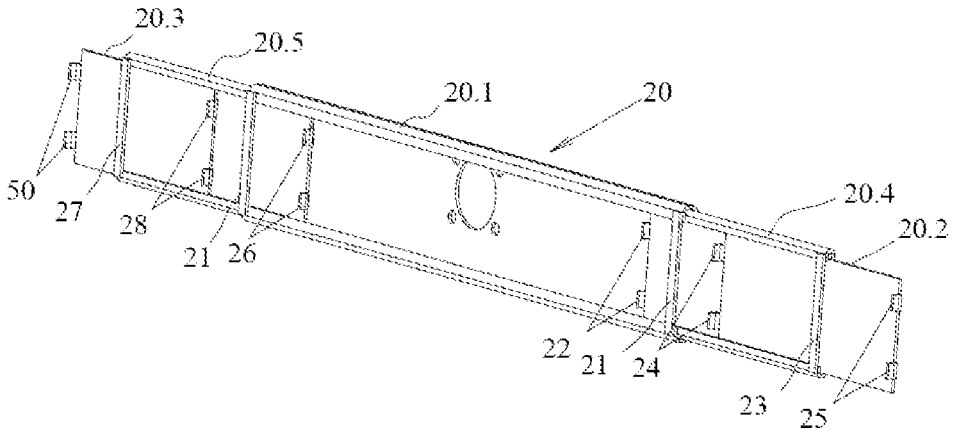
FIG. 5 is a schematic structural view of a baffle component of an embodiment.

In FIG. 5, the support 4 of an embodiment includes a first support plate 4.1 and a second support plate 4.2. The first support plate 4.1 and the second support plate 4.2 are respectively located at two sides of the winding drum 3. The baffle component 20 includes a substrate 20.1, a first clamping plate 20.2 and a second clamping plate 20.3. The first clamping plate 20.2 and the second clamping plate 20.3 are respectively located on two sides of the substrate 20.1. The first clamping plate 20.2 and the second clamping plate 20.3 are both slidably connected to the substrate 20.1. The retractable feature of the baffle component 20 is thereby achieved.

In an embodiment, the baffle component 20 further comprises a first transmission plate 20.4 and a second transmission plate 20.5. The first transmission plate 20.4 is slidably connected to the substrate 20.1. The first clamping plate 20.2 is slidably connected with the first transmission plate 20.4. The second transmission plate 20.5 is slidably connected with the substrate 20.1. The second clamping plate 20.3 is slidably connected with the second transmission plate 20.5. The baffle component 20 can be retracted by a longer distance with the above mentioned configuration.

In an embodiment, the substrate 20.1, the first transmission plate 20.4 and the second transmission plate 20.5 have a C-shaped cross-section. The first transmission plate 20.4 and the second transmission plate 20.5 are both inserted into the substrate 20.1. The first clamping plate 20.2 is inserted in the first transmission plate 20.4. The second clamping plate 20.3 is inserted in the second transmission plate 20.5. First limiting bars 21 are arranged at both ends of the substrate 20.1. The first transmission plate 20.4 has first hooks 22 arranged close to the rope guide block 9 and a second limiting bar 23 facing away from the rope guide block 9. The first clamping plate 20.2 has second hooks 24 arranged close to the rope guide block 9 and third hooks 25 facing away from the rope guide block 9. The second transmission plate 20.5 has fourth hooks 26 arranged close to the rope guide block 9 and a third limiting bar 27 facing away from the rope guide block 9. The second clamping plate 20.3 has fifth hooks 28 arranged close to the rope guide block 9. The first clamping plate 20.2 has sixth hooks 50 facing away from the rope guide block 9. When the substrate 20.1 reciprocates, the first limiting bars 21 are engaged with the first hooks 22 to drive the first transmission plate 20.4, the second limiting bar 23 is engaged with the second hooks 24 to drive the first clamping plate 20.2, the third hooks 25 and the first support plate 4.1 are engaged to limit the first clamping plate 20.2, the first limiting bars 21 are engaged with the third hooks 25 to drive the second transmission plate 20.5, the third limiting bar 27 is engaged with the fourth hooks 26 to drive the second clamping plate 20.3, and the sixth hooks 50 are engaged with the second supporting plate 4.2 to limit the second clamping plate 20.3. This configuration coordinates the displacement of the substrate 20.1 with the displacement of the first clamping plate 20.2 and the second clamping plate 20.3. Sludge can be blocked during the reciprocating movement of the baffle component 20.

Figure 6:
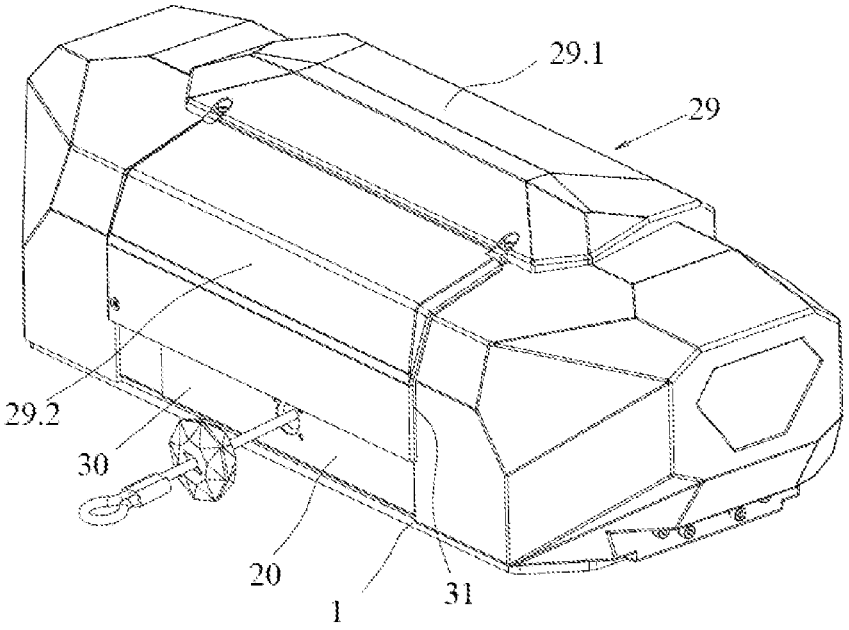
FIG. 6 is a schematic view of the structure of a winch of an embodiment having a casing.
Figure 7:
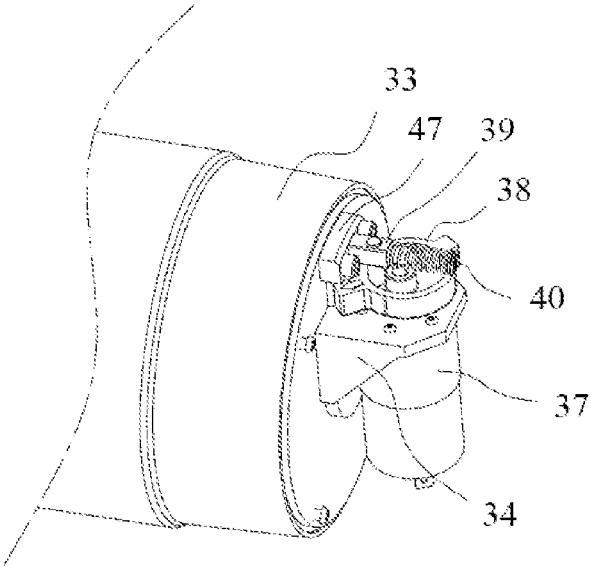
FIG. 7 is a schematic view of a clutch component in a winch of an embodiment.
Figure 8:
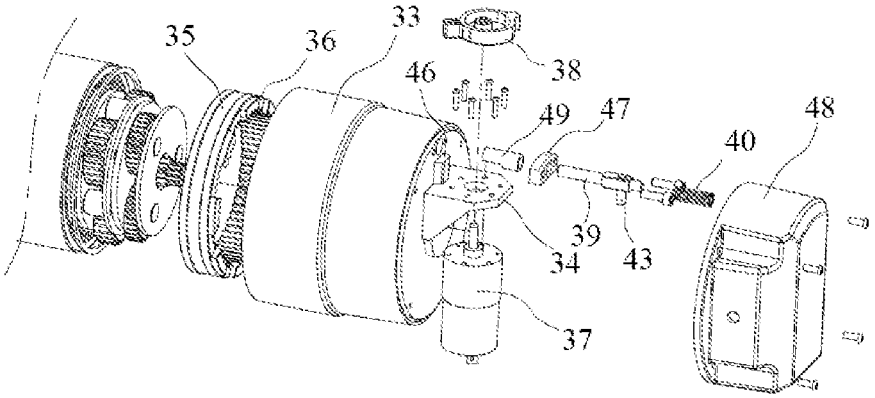
FIG. 8 is an exploded view of the clutch component in a winch of an embodiment.
Figure 9:
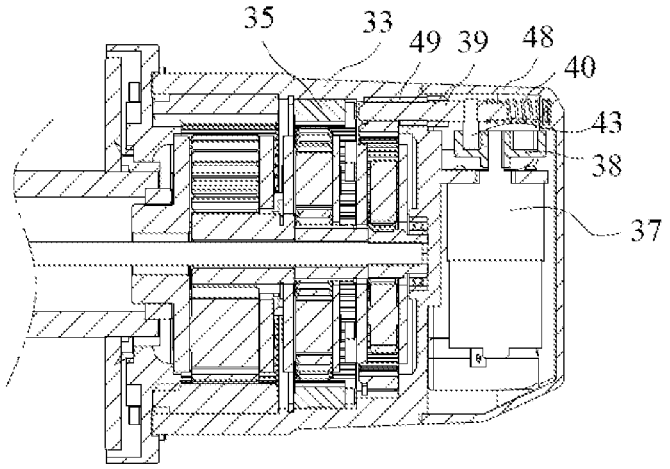
FIG. 9 is a schematic sectional view of the clutch component in a winch of an embodiment.
Figure 10:
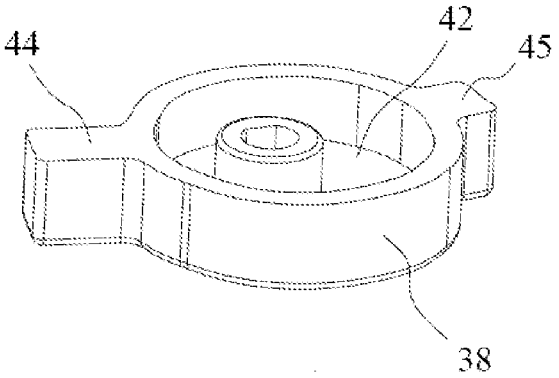
FIG. 10 is a schematic structural view of an eccentric wheel in a winch of an embodiment.
Figure 11:
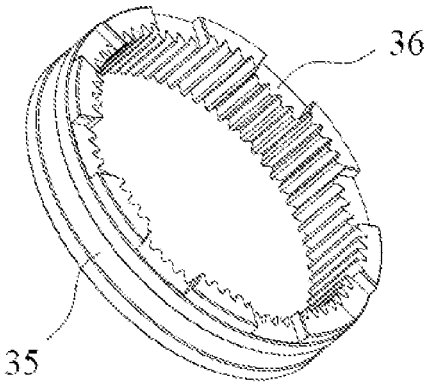
FIG. 11 is a schematic structural view of a ring gear in a winch according to the present disclosure.

As shown in FIG. 6, a winch in an embodiment further comprises a casing 29 for covering the winch. The casing 29 is fixedly connected to the base 1. The casing 29 comprises a let-off port 30 covered by the baffle component 20 for allowing the traction rope 2 to pass through while being wound. The winch can be completely shielded from outer environments by the casing 29 and the baffle component 20.

In an embodiment, the casing 29 comprises a primary casing part 29.1 and a cover plate 29.2. The cover plate 29.2 is hinged to the primary casing part 29.1. The primary casing part 29.1 has a maintenance clearance 31 covered by the cover plate 29.2. Inner components of the winch can be accessed from the cover plate 29.2 during maintenance.

As shown in FIG. 7-11, a winding drum mounting bracket 32 is fixed on the base in an embodiment, and the winding drum 3 is mounted on the winding drum mounting bracket 32. A planetary gear transmission component is connected to one end of the winding drum 3. One side of the winding drum mounting bracket 32 is provided with a gear box cover 33 for covering the planetary gear transmission component. The gear box cover 33 is fixed on the outside with a mounting seat 34 on which a clutch component for driving the planetary gear transmission component is mounted. In this way, it is convenient for the operator to control the clutch component in emergent circumstances to start or stop the winch, and it facilitates usage by controlling the winch to operate using an alternative approach other than the power control approach.

In an embodiment, the planetary gear transmission component has a ring gear 35. A side of the ring gear 35 is provided with a plurality of fixing slots 36. The plurality of the fixing slots 36 are circumferentially arranged along the ring gear 35 and the clutch component includes a motor 37, an eccentric 38 wheel, a bolt 39, and an elastic component 40. The motor 37 is fixed on the mounting seat 34. The driving end of the motor 37 is connected with the eccentric wheel 38 to drive the eccentric wheel 38 to rotate. A let-off aperture is provided on the gear box cover 33. The bolt 39 is inserted into the let-off aperture. The bolt 39 is driven by the eccentric wheel 38 to move back and forth. As the bolt 39 moves toward the ring gear 35, one end of the bolt 39 near the ring gear 35 will be eventually inserted into a fixing slot 36, and the elastic member 40 is used to provide a pushing force to the bolt 39 against the fixing slot 36. Therefore, when the ring gear 35 is restricted from moving, the planetary gear transmission mechanism can be used in the transmission of driving power. When the bolt 39 moves away from the ring gear 35, an end of the bolt 39 close to the ring gear 35 would be disengaged from the fixing slots 36. At this time, the ring gear 35 would be free to rotate and the driving power is not transmitted by the ring gear. The winch is thus in an idle mode. A winch having stable operation is achieved by constructing the clutch component using the cooperation of the bolt 39 and the fixing slots 36.

In an embodiment, the eccentric wheel 38 has an eccentric slot 42 with an increasing width from one side of the eccentric slot 42 to the other side. The bolt 39 has a plug 43 connected to the eccentric slot 42. In this way, when the eccentric wheel 38 rotates, the plug 43 moves within the eccentric slot 42 from one side the other side so as to move the bolt 39 back and forth.

In an embodiment, the outer side of the eccentric wheel 38 is provided with a first limiting block 44 and a second limiting block 45. When the first limiting block 44 is pressed against the gear box cover 33, the end of the bolt 39 is engaged with the fixing slot 36. When the second limiting block 45 abuts against the gear box cover 33, the end of the bolt 39 is disengaged from the fixing slot 36. In this way, the eccentric wheel 38 defines the two positions of the bolt 39 and the respective working modes of the clutch component to provide working stability.

In one embodiment, the gear box cover 33 is provided with a protrusion block 46 for contacting the first limiting block 44 and the second limiting block 45. The protrusion block 46 is used to limit the positions of the first limit block 44 and the second limit block 45.

In one embodiment, the clutch component further includes a guide sleeve 49 and a bolt positioning block 47. The guide sleeve 49 is fixed in the let-off aperture. The bolt positioning block 47 is fixed on the gear box cover 33. The bolt 39 passes through the bolt positioning block 47 and the guide sleeve 49. In this way, the stability of the bolt 39 as well as the clutch component when moving back and forth can be improved.

In one embodiment, an end cap 48 for covering the clutch component is fixedly connected to the gear box cover 33. The elastic component 40 is a compression spring, and the compression spring is sleeved on the bolt 39. One end of the compression spring is in contact with the inner side of the end cap 48.

Although certain embodiments have been illustrated and described herein for purposes of description, a wide variety of alternate and/or equivalent embodiments or implementations to achieve the same purposes may be substituted for the embodiments shown and described without departing from the scope of the present disclosure.

I claim:

1. A winch for a vehicle, including:

a base;

a winding drum for winding a traction rope, the winding drum being fixed on the base;

a support fixed on the base;

a transmission component; and a reciprocating component for driving the traction rope to reciprocate along an axial direction of the winding drum when the traction rope is wound onto or released from the winding drum, wherein the traction rope passes through the reciprocating component, the reciprocating component is mounted on the support, the reciprocating component includes a reciprocating screw rod rotatably connected to the support, one end of the reciprocating screw rod is fixedly connected with a driven wheel, one end of the winding drum is fixed with a main wheel rotating with the winding drum, and the main wheel drives the driven wheel to rotate through the transmission component;

wherein the reciprocating component comprises:

a polished rod fixed on the support;

a rope guide block on which the traction rope is threaded, the reciprocating screw rod passing through the rope guide block to drive the rope guide block to move back and forth;

a guide sleeve fixed on the rope guide block and in slidable connection with the polished rod, the inner side walls of both ends of the guide sleeve connected with O-rings, each O-ring attached to the outer surface of the polished rod;

teeth fixed on the rope guide block to engage the reciprocating screw rod; and a retractable baffle component fixedly connected to the rope guide block, wherein the transmission component comprises a retractable baffle component fixedly connected to the rope guide block, and the rope guide block reciprocates the baffle component when reciprocating;

wherein the support includes a first support plate and a second support plate, the first support plate and the second support plate are respectively located at two sides of the winding drum, the baffle component includes a substrate, a first clamping plate and a second clamping plate, the first clamping plate and the second clamping plate are respectively located on two sides of the substrate, and the first clamping plate and the second clamping plate are both slidably connected to the substrate.

2. The winch of claim 1, wherein the transmission component includes a first transmission wheel, a second transmission wheel, a third transmission wheel, a fourth transmission wheel, a first rotating shaft, a second rotating shaft and a mounting housing fixedly connected with the support, the first rotating shaft and the second rotating shaft are rotatably connected to the support and the mounting housing, the axes of the first rotating shaft, the second rotating shaft, the reciprocating screw rod and the winding drum are parallel to each other, one end of the first rotating shaft passes through the support, the first transmission wheel is fixed on one end of the first rotating shaft and on a side of the support facing the winding drum, the second transmission wheel is fixed on the other end of the first rotating shaft and on a side of the support facing away from the winding drum, the third transmission wheel and the fourth transmission wheel are both fixed on the second rotating shaft and between the support and the mounting housing, the main wheel drives the first transmission wheel to rotate, the second transmission wheel drives the third transmission wheel to rotate, and the fourth transmission wheel drives the driven wheel to rotate.

3. The winch of claim 1, wherein the baffle component further comprises a first transmission plate and a second transmission plate, the first transmission plate is slidably connected to the substrate, the first clamping plate is slidably connected with the first transmission plate, the second transmission plate is slidably connected with the substrate, and the second clamping plate is slidably connected with the second transmission plate.

4. The winch of claim 3, wherein the substrate, the first transmission plate and the second transmission plate have a C-shaped cross-section, the first transmission plate and the second transmission plate are both inserted into the substrate, the first clamping plate is inserted in the first transmission plate, the second clamping plate is inserted in the second transmission plate, first limiting bars are arranged at both ends of the substrate, the first transmission plate has first hooks arranged close to the rope guide block and a second limiting bar facing away from the rope guide block, the first clamping plate has second hooks arranged close to the rope guide block and third hooks facing away from the rope guide block, the second transmission plate has fourth hooks arranged close to the rope guide block and third limiting bars facing away from the rope guide block, the second clamping plate has fifth hooks arranged close to the rope guide block, and the first clamping plate has sixth hooks facing away from the rope guide block, and wherein when the substrate reciprocates, the first limiting bars are engaged with the first hooks to drive the first transmission plate, the second limiting bar is engaged with the second hooks to drive the first clamping plate, the third hooks and the first support plate are engaged to limit the first clamping plate, the first limiting bars are engaged with the third hooks to drive the second transmission plate, the third limiting bar is engaged with the fourth hooks to drive the second clamping plate, and the sixth hooks are engaged with the second supporting plate to limit the second clamping plate.

5. The winch of claim 1, further comprising a casing for covering the winch, the casing being fixedly connected to the base, the casing comprising a let-off port covered by the baffle component for allowing the traction rope to pass through while being wound.

6. The winch of claim 5, wherein the casing comprises a primary casing part and a cover plate, the cover plate being hinged to the primary casing part, the primary casing part having a maintenance clearance covered by the cover plate.

* * * * *